US011897022B2

(12) United States Patent
Kachi et al.

(10) Patent No.: US 11,897,022 B2
(45) Date of Patent: Feb. 13, 2024

(54) FIN, HEAT EXCHANGER WITH FIN, AND METHOD OF MANUFACTURING FIN

(71) Applicant: DENSO CORPORATION, Kariya (JP)

(72) Inventors: Kenichi Kachi, Kariya (JP); Hisashi Kobayashi, Kariya (JP); Sachi Onaga, Kariya (JP); Kazuhiro Mitsukawa, Kariya (JP); Yoshinori Sakimoto, Kariya (JP); Taichi Asano, Kariya (JP); Kazutaka Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 272 days.

(21) Appl. No.: 16/513,923

(22) Filed: Jul. 17, 2019

(65) Prior Publication Data

US 2019/0337043 A1 Nov. 7, 2019

Related U.S. Application Data

(63) Continuation of application No. PCT/JP2017/043081, filed on Nov. 30, 2017.

(30) Foreign Application Priority Data

Jan. 20, 2017 (JP) ..... 2017-008229

(51) Int. Cl.
*B21D 53/02* (2006.01)
*B21D 13/04* (2006.01)
*F28F 1/12* (2006.01)

(52) U.S. Cl.
CPC ..... *B21D 53/022* (2013.01); *B21D 13/04* (2013.01); *F28F 1/126* (2013.01)

(58) Field of Classification Search
CPC ..... B21D 53/00; B21D 53/02; B21D 53/022; B21D 53/025; B21D 53/04; B21D 13/00; B21D 13/04; B21D 13/045; B21D 13/08; B21D 13/10; B21D 13/02
See application file for complete search history.

(56) References Cited

U.S. PATENT DOCUMENTS

| | | | | |
|---|---|---|---|---|
| 10,384,250 | B2 * | 8/2019 | Hirata | H01M 8/021 |
| 2004/0188072 | A1 | 9/2004 | Gerard | |
| 2007/0255213 | A1 * | 11/2007 | Itoh | F28F 1/42 604/113 |

FOREIGN PATENT DOCUMENTS

| | | | |
|---|---|---|---|
| GB | 2095595 | A | 10/1982 |
| JP | 2003083692 | A | 3/2003 |
| JP | 2003279279 | A | 10/2003 |
| JP | 2003336989 | A | 11/2003 |
| WO | WO-2005080018 | A1 | 9/2005 |

* cited by examiner

*Primary Examiner* — Debra M Sullivan
(74) *Attorney, Agent, or Firm* — Harness, Dickey & Pierce, P.L.C.

(57) ABSTRACT

A fin according to the present disclosure is a corrugated fin formed of a metal plate by bending into a corrugated shape, and the corrugated fin includes peak portions extending in a first direction, valley portions extending in the first direction, and inclined portions connecting the peak portions and the valley portions adjacent to each other. The peak portions and the valley portions are alternately arranged in a second direction perpendicular to the first direction, and a thickness of the metal plate at each apex of the peak portions and the valley portions is larger than a thickness of the inclined portions of the metal plate.

7 Claims, 9 Drawing Sheets

COMPARATIVE EXAMPLE

FIN, HEAT EXCHANGER WITH FIN, AND METHOD OF MANUFACTURING FIN

CROSS REFERENCE TO RELATED APPLICATIONS

The present application is a continuation application of International Patent Application No. PCT/JP2017/043081 filed on Nov. 30, 2017, which designated the United States and claims the benefit of priority from Japanese Patent Application No. 2017-008229 filed on Jan. 20, 2017. The entire disclosures of all of the above applications are incorporated herein by reference.

TECHNICAL FIELD

The present disclosure relates to a corrugated fin formed of a metal plate by bending into a corrugated shape, a heat exchanger including the fin, and a method of manufacturing the fin.

BACKGROUND

For example, a heat exchanger such as a radiator mounted on a vehicle includes a fin for increasing contact area with a fluid. Such a fin may be an inner fin provided inside the tube through which the fluid flows, or an outer fin provided between tubes adjacent to each other. A heat exchanger including the inner fin and the outer fin described above is known. Each fin has peak portions and valley portions extending straight in a predetermined direction and arranged alternately in a direction perpendicular to the predetermined direction. An apex of each of the peak portion and the valley portion is brazed to a wall surface of the tube.

SUMMARY

A fin according to the present disclosure is a corrugated fin formed of a metal plate by bending into a corrugated shape, and the corrugated fin includes peak portions extending in a first direction, valley portions extending in the first direction, and inclined portions connecting the peak portions and the valley portions adjacent to each other. The peak portions and the valley portions are alternately arranged in a second direction perpendicular to the first direction, and a thickness of the metal plate at each apex of the peak portions and the valley portions is larger than a thickness of the inclined portions of the metal plate.

EMBODIMENTS

Figure 1:
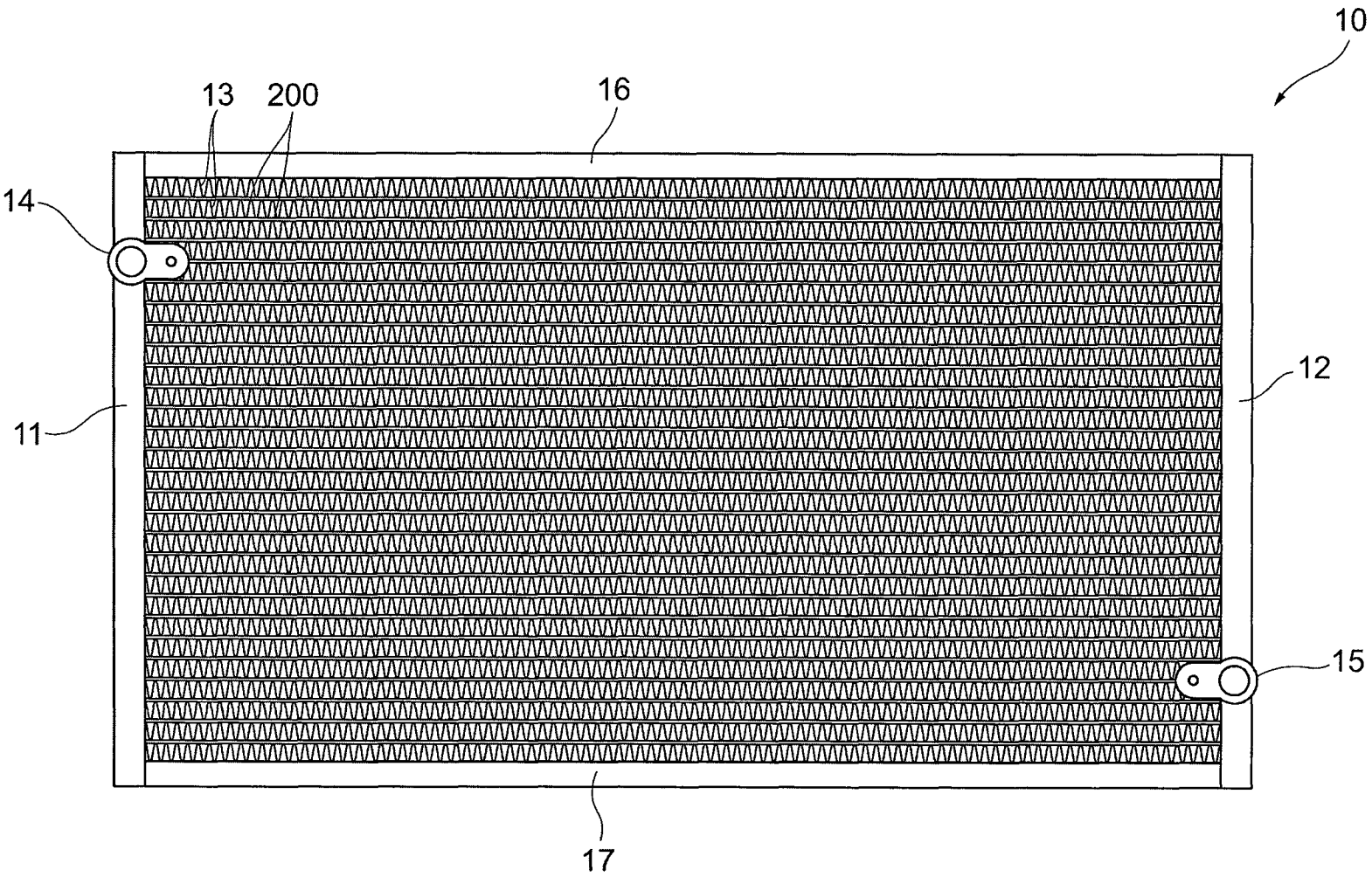
FIG. 1 is a diagram illustrating the overall structure of a heat exchanger according to an embodiment.

Hereinafter, the present embodiment will be described with reference to the attached drawings. In order to facilitate the ease of understanding, the same reference numerals are attached to the same constituent elements in each drawing where possible, and redundant explanations are omitted.

A heat exchanger 10 according to a present embodiment will be described. The heat exchanger 10 is configured as a condenser for a refrigeration cycle of a vehicular air-conditioning device (not shown). In the heat exchanger 10, heat exchange is performed between a flowing refrigerant and air, whereby the refrigerant condenses and changes from gas phase to liquid phase. As shown in FIG. 1, the heat exchanger 10 includes a tank 11, a tank 12, tubes 200, and fins 13.

The tank 11 is a container configured to temporarily store the refrigerant supplied from an outside. The tank 11 is a long and thin container having an approximately circular column shape, and the tank 11 is arranged such that a longitudinal direction of the tank 11 is along a vertical direction.

A receiving portion 14 is provided at a part of an upper half of the tank 11 in the vertical direction. The refrigerant is received by the receiving portion 14 and flows into the tank 11 through the receiving portion 14. The receiving portion 14 is provided as a connector for connecting pipes of the refrigeration cycle through which the refrigerant flows.

The tank 12 is provided as a container for temporarily storing the refrigerant similarly to the tank 11. The tank 12 is a long and thin container having an approximately circular column shape, and the tank 12 is arranged such that a longitudinal direction of the tank 12 is along the vertical direction. The tank 12 is arranged such that the longitudinal direction of the tank 12 is parallel to the longitudinal direction of the tank 11.

A discharge portion 15 is provided at a part of a lower half of the tank 12 in the vertical direction. The discharge portion 15 is a component for discharging, to the outside of the tank 12, the refrigerant flowing to the tank 12 through the tubes 200. The discharge portion 15 is provided as a connector for connecting pipes of the refrigeration cycle through which the refrigerant flows, similarly to the receiving portion 14 of the tank 11.

Figure 2:
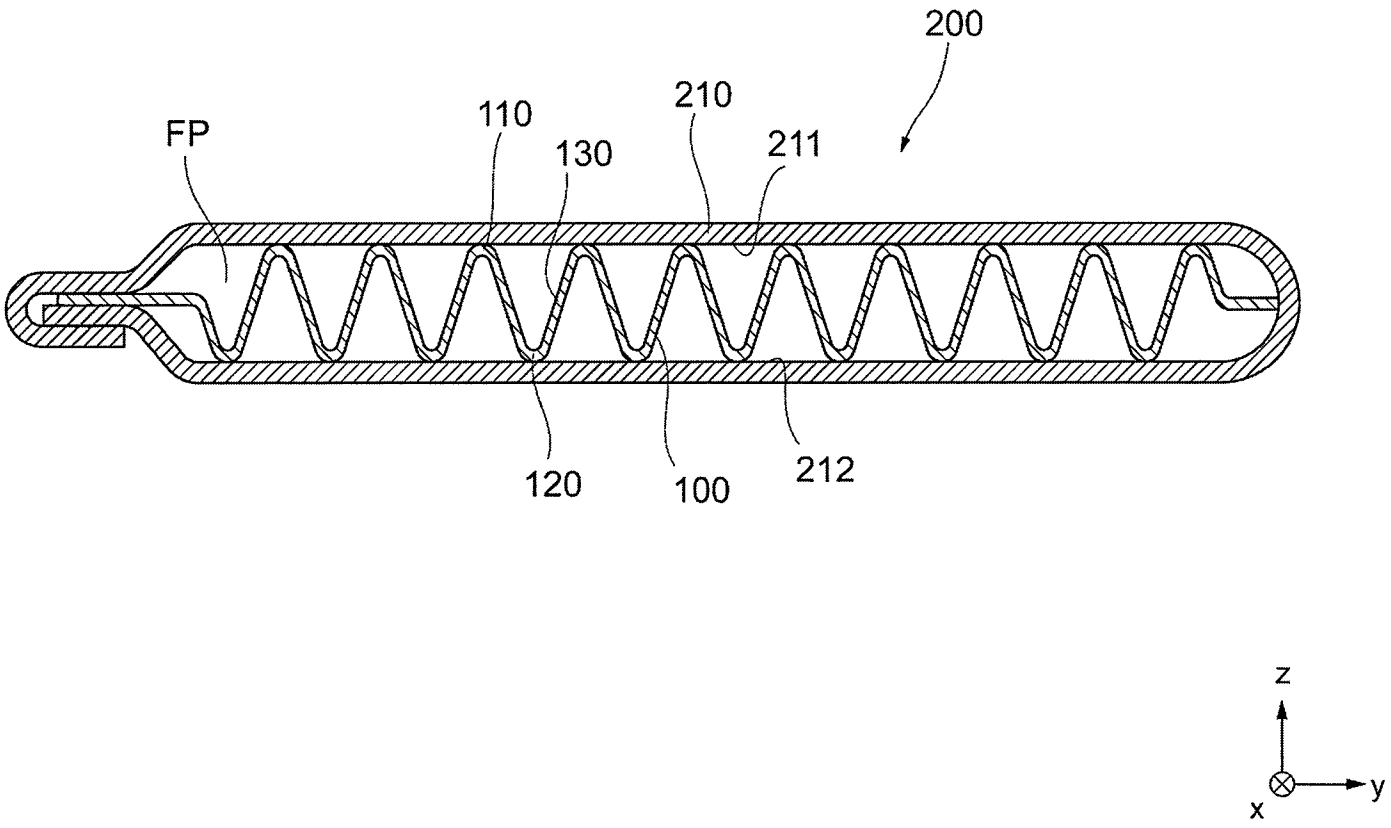
FIG. 2 is a cross-sectional diagram illustrating a tube of the heat exchanger of FIG. 1.

The tube 200 is a metal tube having a cylindrical shape, and multiple tubes 200 are provided in the heat exchanger 10. As shown in FIG. 2, flow passages FP through which the refrigerant flows are defined in the tube 200. A shape of the tube 200 in a cross-section taken in a direction perpendicular to a flow direction of the refrigerant is a flat shape, and a longitudinal direction of the flat shape is along a flow direction of air (a direction perpendicular to the drawing sheet of FIG. 1; a left-right direction in FIG. 2).

As shown in FIG. 2, the tube 200 includes an outer shell 210 and a fin 100. The outer shell 210 has a plate shape formed of thin aluminum alloy. The outer shell 210 is bent at a center portion (a portion on the right side in FIG. 2), and ends (portions on the left side in FIG. 2) are crimped in a state where the ends are overlapped.

The fin 100 is formed by bending a metal plate into a corrugated shape, and is disposed inside the tube 200, that is, in the flow passage FP. The fin 100 increases the contact area between the tube 200 and the refrigerant flowing through the flow passage FP. Accordingly, the heat is efficiently transferred to the refrigerant flowing through the flow passage FP. Thus, the fin 100 is provided as so-called "inner fin". The fin 100 corresponds to the "corrugated fin" of the present embodiment. The specific shape of the fin 100 will be described later.

As shown in FIG. 1, each of the tubes 200 has one end connected to the tank 11 and the other end connected to the tank 12. Accordingly, the inside space of the tank 11 communicates with the inside space of the tank 12 through the tubes 200.

The longitudinal direction of the tube 200 is perpendicular to the longitudinal direction of the tank 11, for example, and the tubes 200 are held in a state where the tubes 200 are stacked with each other in the longitudinal direction of the tank 11 (i.e. the vertical direction), for example.

The fin 13 is formed by bending a metal plate into a corrugated shape, and is inserted between the tubes 200 adjacent to each other. Top portions (apexes of peak portions and valley portions) of the fin 13 are brazed to sides (an upper surface or a lower surface) of the tube 200. During the operation of the refrigeration cycle, the heat of the refrigerant is transferred to the air through the tube 200 and also to the air through both the tube 200 and the fins 13. That is, the contact area with the air is increased by the fin 13, and thereby the heat exchange between the air and the refrigerant is efficiently performed. Thus, the fin 13 is provided as so-called "outer fin".

The portion where all the stacked tubes 200 and fins 13 are disposed is a portion where the heat exchange between air and the refrigerant is performed, and is so-called "heat exchange core portion". Side plates 16, 17, which are metal plates, are provided at positions above and below the heat exchange core portion. The side plates 16, 17 sandwich the heat exchange core portion from the upper side and the lower side to reinforce the heat exchange core portion and maintain the shape of the heat exchange core portion.

The flow of the refrigerant when the refrigeration cycle is in operation will be described. The refrigerant is compressed by a compressor (not shown) located upstream of the heat exchanger 10 in the refrigeration cycle, and is supplied to the heat exchanger 10 with its temperature and pressure increased. At this time, the refrigerant is almost entirely in the gas phase. The refrigerant flows into the inside of the tank 11 from the receiving portion 14 and is temporarily stored in the inner space of the tank 11. The refrigerant flows from the tank 11 into the inside of the tubes 200, and flows toward the tank 12 through the passage FP.

The refrigerant reaching the tank 12 is temporarily stored in the inner space of the tank 12, and then discharged from the discharge portion 15 to the outside. Subsequently, the refrigerant flows toward an expansion valve (not shown) located downstream of the heat exchanger 10 in the refrigeration cycle.

The refrigerant is cooled by the external air passing through the heat exchange core portion during flowing through the inside of the tube 200 (the flow passage FP). That is, the heat is released from the refrigerant to the air. Accordingly, the temperature of the refrigerant flowing through the inside of the tube 200 is decreased, and a part or all of the refrigerant changes from the gas phase to the liquid phase. Also, the air passing through the heat exchange core is heated, and the temperature of the air is increased.

The inside spaces of the tanks 11, 12 may be partitioned by separators such that the refrigerant flows between the tank 11 and the tank 12 in a loop. Moreover, the heat exchanger 10 may be used as an evaporator instead of a condenser. Furthermore, the fluid flowing inside the heat exchanger 10 may be another fluid other than the refrigerant. For example, the heat exchanger 10 may be configured as a radiator for radiating heat from the cooling water that has passed through the internal combustion engine.

Figure 3:
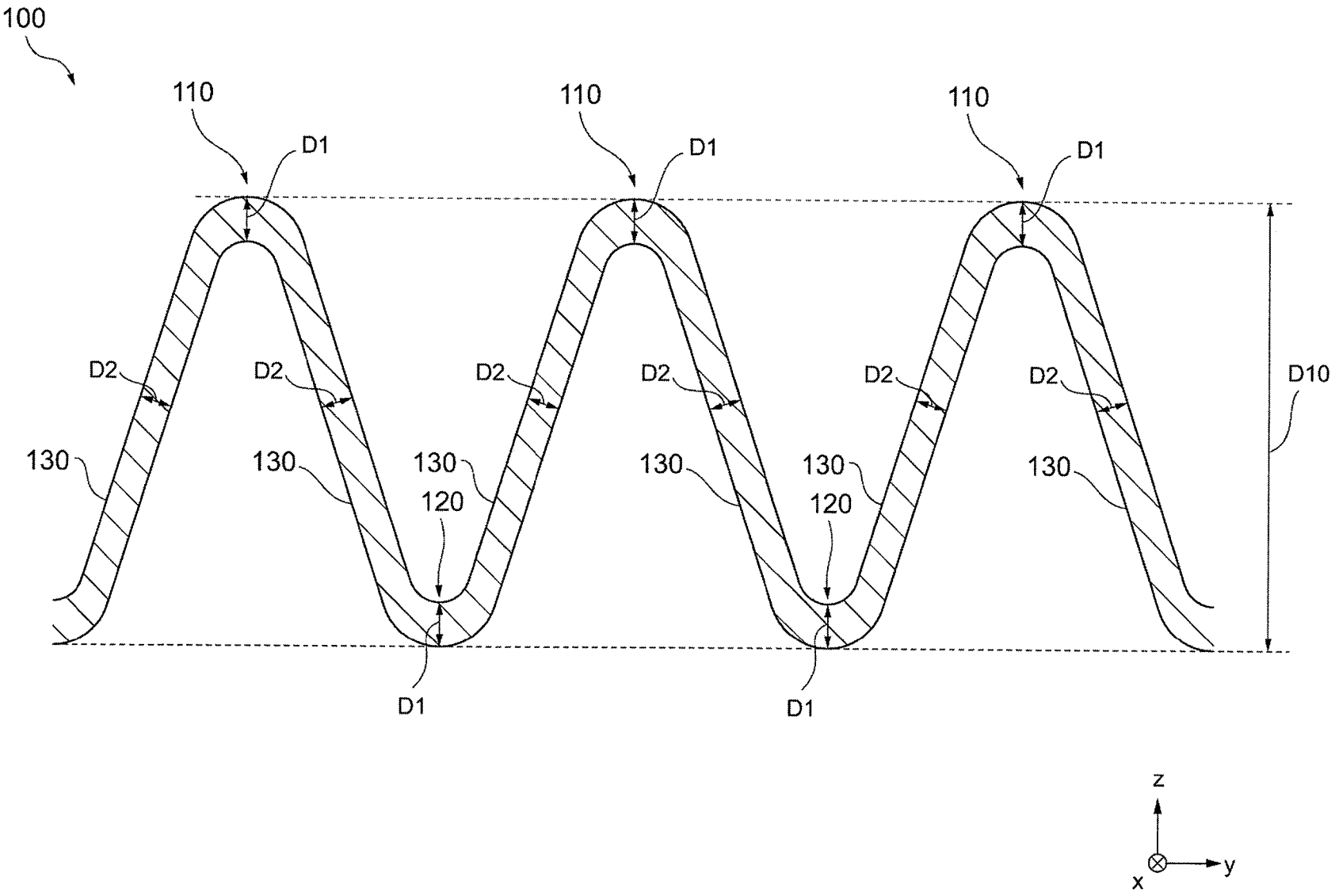
FIG. 3 is a diagram showing a shape of a fin.

The specific shape of the fin 100 will be described with reference to FIGS. 2, 3. In FIGS. 2, 3, the direction from the front side to the back side of the drawing is an x direction, and an x-axis is set along the x direction. A direction that is perpendicular to the x direction and extends from the left to the right is a y direction, and a y-axis is set along the y direction. Furthermore, a direction perpendicular to both the x direction and the y direction, that is, a direction from the lower side to the upper side is a z direction, and a z-axis is set along the z direction. The same applies to FIG. 5 and the following figures.

The fin 100 formed by bending the metal plate into a corrugated shape has multiple peak portions 110 protruding in the z direction. The peak portions 110 extend in the x direction. The valley portions 120 protruding in a −z direction extend along the x direction. The x direction corresponds to the "first direction" of the present embodiment. The peak portions 110 and the valley portions 120 are alternately arranged in the y direction perpendicular to the x direction. The y direction corresponds to the "second direction" of the present embodiment. The peak portion 110 and the valley portion 120 adjacent to each other are connected through an inclined portion 130 that is a part inclined with respect to the y-axis.

The peak portion 110 and the valley portion 120 in the present embodiment have symmetrical shapes along the z-axis. For this reason, depending on the direction in which the fin 100 is viewed, the peak portion 110 may be a "valley portion" and the valley portion 120 may be a "peak portion". Here, for convenience of explanation, the portion with reference numeral 110 is referred to as "the peak portion 110", and the portion with reference numeral 120 is referred to as "the valley portion 120".

A height of the fin 100, i.e. a distance along the z-axis from the apex of the peak portion 110 to the apex of the valley portion 120, is uniform throughout. In FIG. 3, the height of the fin 100 is shown as a height D10.

The apex of each peak portion 110 of the fin 100 is in contact with the inner wall surface 211 on the z direction side of the outer shell 210 and is brazed to the inner wall surface 211 with a brazing material (not shown). The apex of each valley portion 120 of the fin 100 is in contact with the inner wall surface 212 on the −z direction side of the outer shell 210 and is brazed to the inner wall surface 212 with a brazing material (not shown). These brazing materials are previously disposed as a layer covering the surfaces of the inner wall surfaces 211, 212. That is, the outer shell 210 is formed preliminarily as a so-called "clad material".

When the brazing of the fin 100 to the outer shell 210 is performed, the outer shell 210 and the fin 100 are heated in the heating furnace with the fin 100 being disposed inside the outer shell 210 as shown in FIG. 2. As a result, the brazing material covering the surfaces of the inner wall surfaces 211, 212 melts, and both the fins 100 and the outer shell 210 become wet by the brazing material. Thereafter, when the heating is finished and the temperature of the outer shell 210 and the like decreases, the brazing material solidifies, and the fin 100 is brazed to the outer shell 210.

In the present embodiment, the outer shell 210 and the fin 100 are made of aluminum. The brazing material is made of Al—Si based alloy. When brazing is performed in such a configuration, a phenomenon, in which a portion of the fin 100 is eroded by the molten brazing material, may occur.

Such a phenomenon is also called "erosion". Since the fin 100 is a thin metal plate, there may be a concern that the fin 100 may be eroded wholly in the thickness direction by the brazing material. In the present embodiment, the whole erosion in the thickness direction by the brazing material is suppressed by modifying the thickness of the fin 100.

As shown in FIG. 3, the thickness of the fin 100 is not uniform throughout, and a portion thereof is thicker than the other portions. Specifically, the thickness D1 of the metal plate at each of the apexes of the peak portions 110 and the valley portions 120 is greater than the thickness D2 of the metal plate at the inclined portions 130. That is, the thickness D1 of the portion of the fin 100 brazed to the outer shell 210 is larger than the thickness D2 of the portion that is not brazed.

The thickness of the fin 100 is large at the apexes of the peak portions 110 and the valley portions 120 which are brazed. Accordingly, the fin 100 is not wholly eroded in the thickness direction by the brazing material even if the erosion occurs when the fin 100 contacts with the brazing material. In addition, since the thickness of the fin 100 is small at the inclined portion 130, the weight of the fin 100 does not increase excessively, and the material cost of the fin 100 does not increase excessively. As described above, according to the fin 100 of the present embodiment, it is possible to suppress the erosion of the fin 100 due to the erosion in addition to suppressing the increase in the weight and the material cost of the fin 100. Moreover, the increase in the weight and material cost of the heat exchanger 10 including the fin 100 can be suppressed.

Figure 4:
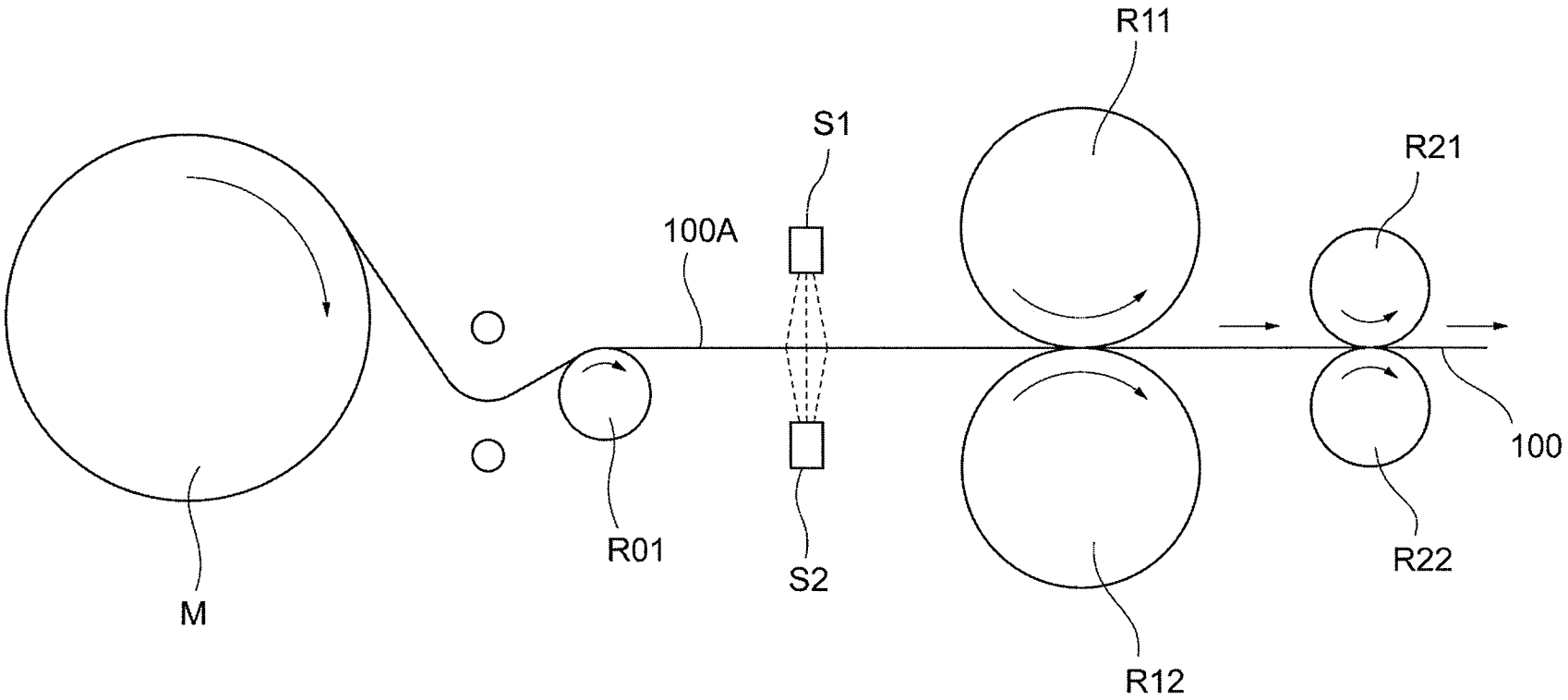
FIG. 4 is a diagram for explaining a method of manufacturing the fin.

The manufacturing method of the fin 100 will be described below. In FIG. 4, an equipment for manufacturing the fin 100 is schematically illustrated. The equipment includes a material M, a support roller R01, shaping rollers R11, R12, and correction rollers R21, R22.

The material M is formed by rolling up a flat metal plate 100A, which is a material of the fin 100, into a cylindrical column shape. The material M is arranged such that the central axis thereof is along the direction perpendicular to the drawing sheet, and the material M is rotated in the clockwise direction about the central axis in FIG. 4. Thereby, the metal plate 100A is fed to the support roller R01.

The support roller R01 supports the lower side of the metal plate 100A and rotates to feed the metal plate 100A toward the shaping rollers R11, R12. After passing through the support roller R01, the metal plate 100A is substantially along the horizontal direction.

Machine oil is supplied to the metal plate 100A after the metal plate 100A has passed through the support roller R01 from oil supply portions S1, S2. The machine oil is for reducing the friction between the shaping rollers R11, R12 and the metal plate 100A. The oil supply portions S1, S2 are disposed on the upper surface side and the lower surface side of the metal plate 100A, respectively, and spray the machine oil to the respective surfaces of the metal plate 100A.

The process of feeding the metal plate 100A from the material M to the shaping rollers R11, R12 is a process of preparing the flat metal plate 100A, and corresponds to the "preparation process" in the present embodiment.

The shaping rollers R11, R12 are for shaping the metal plate 100A into a corrugated shape to form the fin 100 by sandwiching the metal plate 100A in the vertical direction. Each of the shaping rollers R11, R12 has a substantially cylindrical column shape, and is arranged such that the central axis thereof is along the direction perpendicular to the drawing sheet. The shaping roller R11 disposed on the upper side rotates in the counterclockwise direction in FIG. 4 about its central axis. The shaping roller R12 disposed on the lower side rotates in the clockwise direction in FIG. 4 about its central axis. Thus, the metal plate 100A is shaped into a corrugated shape, and is then fed to the correction rollers R21, R22 described later. The shaping roller R11 corresponds to a "first roller" of the present embodiment, and the shaping roller R12 corresponds to a "second roller" of the present embodiment.

Figure 5:
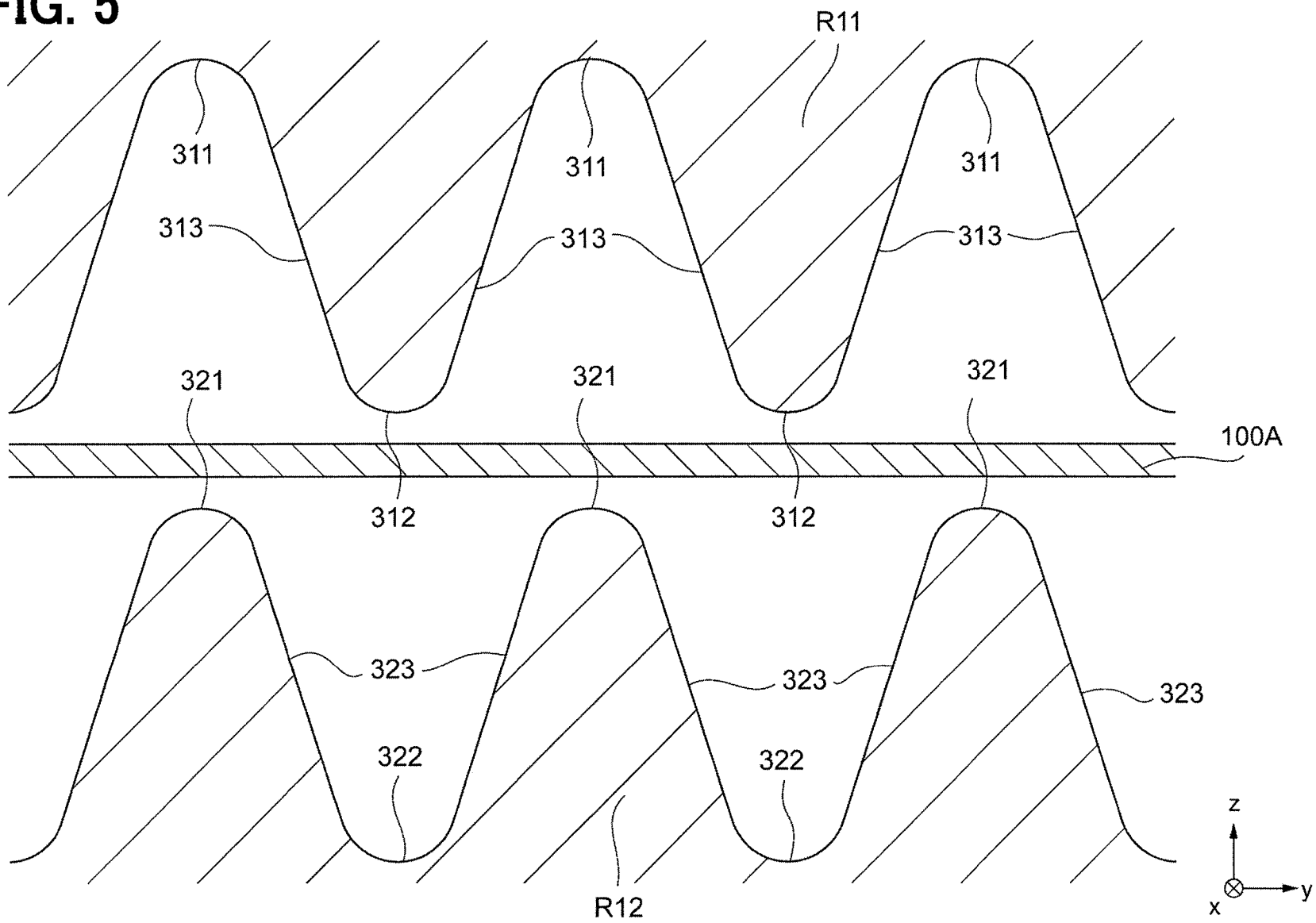
FIG. 5 is a diagram illustrating how the fin is shaped by rollers.
Figure 6:
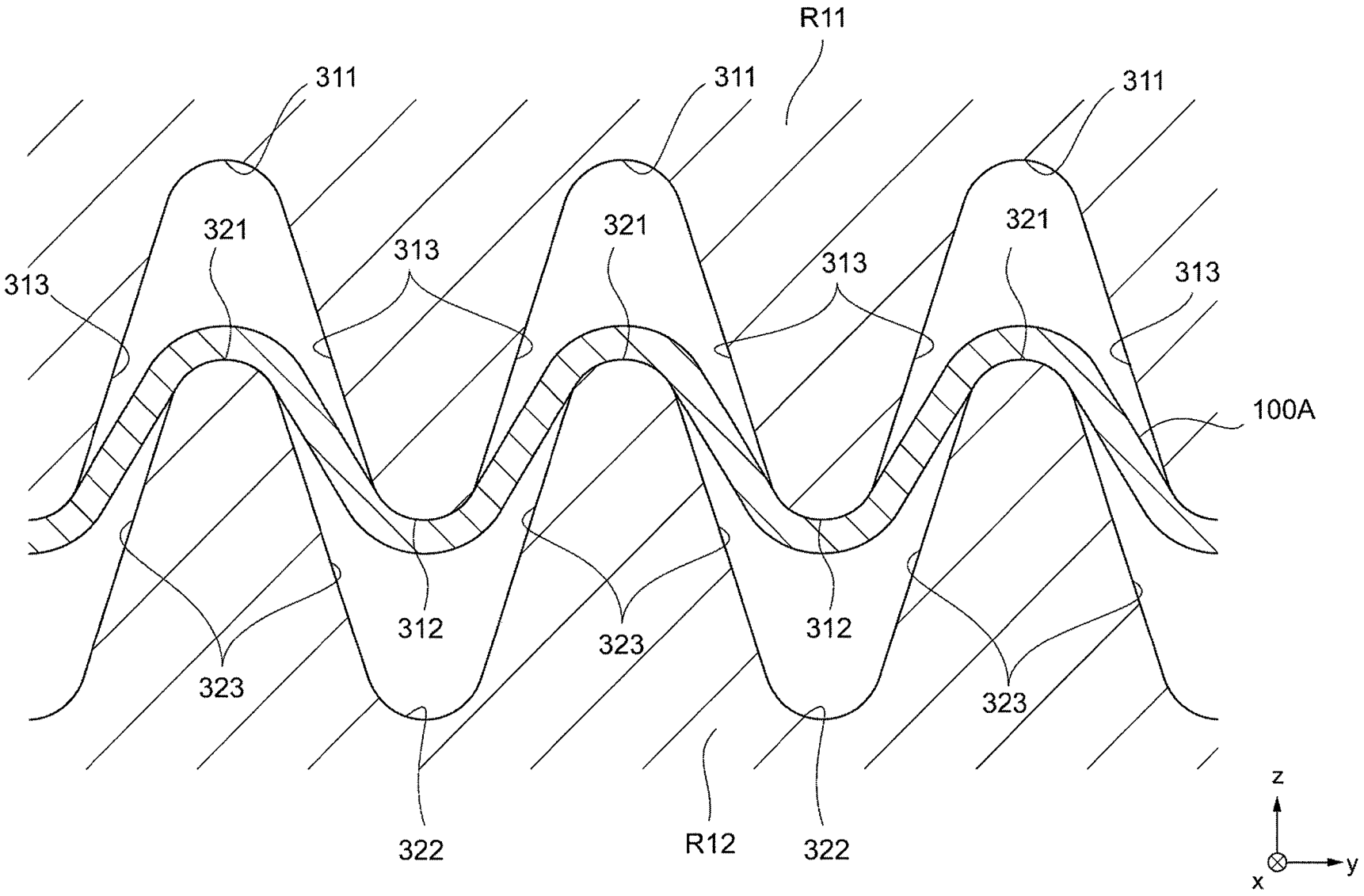
FIG. 6 is a diagram illustrating how the fin is shaped by rollers.
Figure 7:
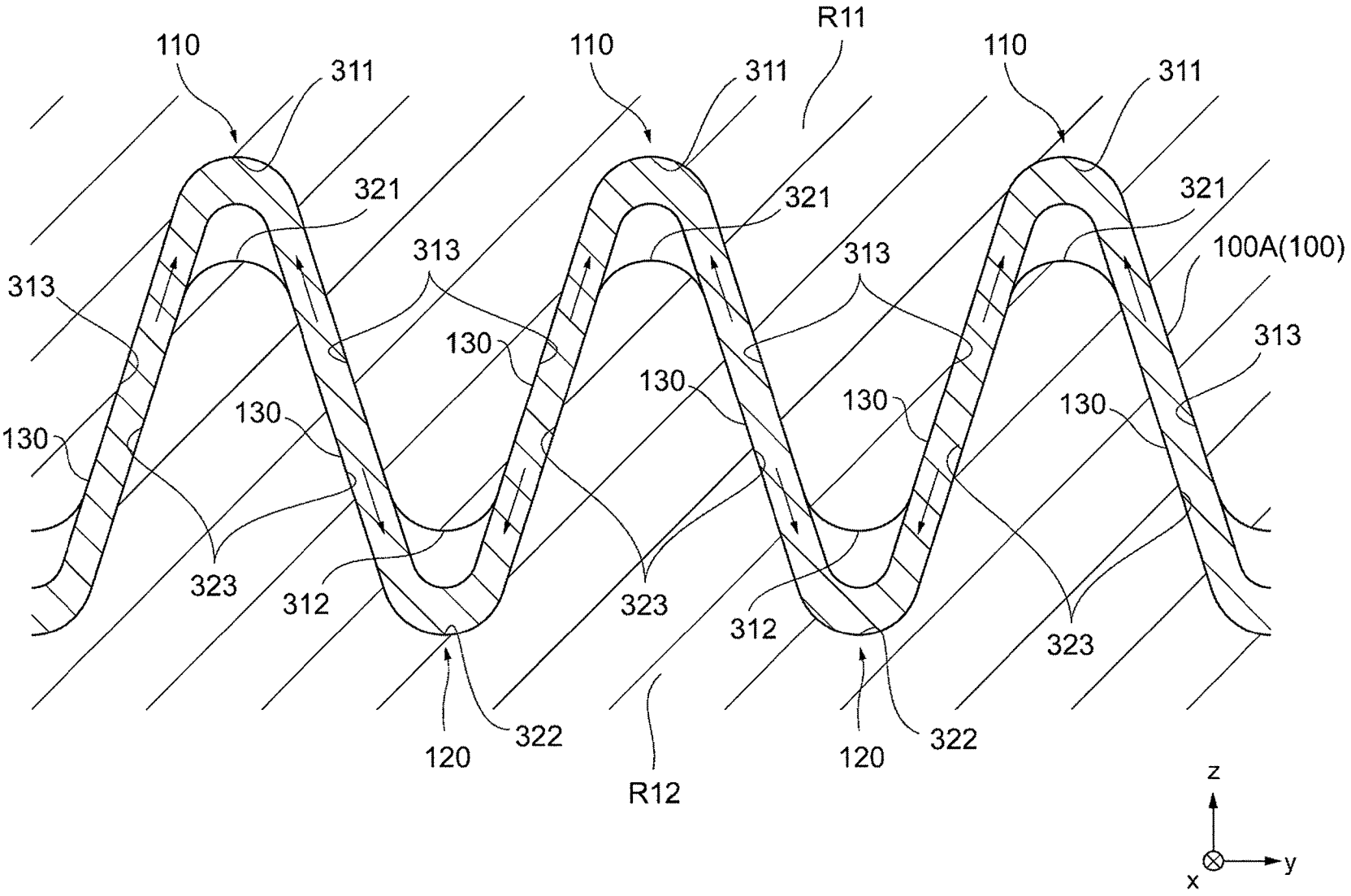
FIG. 7 is a diagram illustrating how the fin is shaped by rollers.

The manner in which the metal plate 100A is shaped by the shaping rollers R11, R12 will be described with reference to FIGS. 5-7. FIGS. 5-7 schematically show cross sections perpendicular to the direction in which the metal plate 100A is fed. FIG. 7 shows a cross section of a portion where the shaping roller R11 and the shaping roller R12 are closest to each other.

In the process in which the metal plate 100A is fed from the support roller R01 to reach the position shown in FIG. 7, the surfaces of the shaping rollers R11, R12 approach the metal plate 100A from above and below. FIGS. 5-7 sequentially show that the shaping rollers R11, R12 approach the metal plate 100A in this manner.

That is, FIG. 5 shows a cross section of a part closer to the material M (the left side in FIG. 4) than a part shown in FIG. 7. In FIG. 6, a cross-section of a part of the metal plate 100A closer to the material M (the left side in FIG. 4) than a part shown in FIG. 7 and farther from the material M (the right side in FIG. 5) than a part shown in FIG. 5.

As shown in FIGS. 5 to 7, concave portions 311 and convex portions 312 are formed on the surface of the shaping roller R11, and they are alternately arranged along the y direction. The concave portion 311 is recessed in the z direction, and the convex portion 312 protrudes in the −z direction (that is, toward the shaping roller R12 side). Each concave portion 311 is a portion for receiving the metal plate 100A to form the peak portion 110. Each convex portion 312 is a portion for pressing the metal plate 100A to form the valley portion 120.

An oblique portion 313 is formed between the concave portion 311 and the convex portion 312. The oblique portion 313 is a portion for forming the inclined portion 130 by sandwiching and pressing, with an oblique portion 323 described later, the metal plate 100A.

Convex portions 321 and concave portions 322 are formed on the surface of the shaping roller R12, and they are alternately arranged along the y direction. The convex portion 321 protrudes in the z direction (that is, toward the shaping roller R11 side) at a position facing the concave portion 311 along the z axis. The concave portion 322 is recessed in the −z direction at a position facing the convex portion 312 along the z-axis. Each convex portion 321 is a portion for pressing the metal plate 100A to form the peak portion 110. Each concave portion 322 is a portion for receiving the metal plate 100A to form the valley portion 120.

An oblique portion 323 is formed between the convex portion 321 and the concave portion 322, that is, at a position facing the oblique portion 313 along the z-axis. As described above, the oblique portion 323 is a portion for forming the inclined portion 130 by sandwiching and pressing, with the oblique portion 313, the metal plate 100A.

At the position shown in FIG. 5, the shaping rollers R11, R12 have not yet come in contact with the metal plate 100A. For this reason, the metal plate 100A remains substantially flat.

In the position shown in FIG. 6, the convex portion 312 and the convex portion 321 are in contact with the metal plate 100A, and accordingly the metal plate 100A begins to be shaped into a corrugated shape. The thickness of the metal plate 100A in the state shown in FIG. 6 is generally uniform throughout.

At the position shown in FIG. 7, the distance between the shaping roller R11 and the shaping roller R12 is the smallest. At this position, the distance between the oblique portion 313 and the oblique portion 323 is smaller than the thickness of the metal plate 100A at the beginning. Since parts of the metal plate 100A are sandwiched and pressed by the oblique portions 313, 323, the thickness of the parts becomes thinner. The parts are portions to be the inclined portions 130 of the fin 100.

In contrast, the distance between the concave portion 311 and the convex portion 321 facing each other, and the distance between the convex portion 312 and the concave portion 322 facing each other are larger than the thickness of the metal plate 100A at the beginning and larger than the thickness D1 shown in FIG. 3. For this reason, a part of the fin 100 in contact with the convex portion 321 or the convex portion 312 is not compressed.

When the metal plate 100A is compressed by the oblique portions 313, 323 as described above, the material of the metal plate 100A is pushed to portions that are not compressed. That is, the metal plate 100A is deformed such that the metal material moves toward the portions of the metal plate 100A facing the convex portion 312 or the convex portion 321. In FIG. 7, the movement of the metal material described above is represented by arrows.

Since the metal material moves, the thickness of the portion of the metal plate 100A facing the concave portion 311 becomes larger than the thickness of the portion compressed by the oblique portions 313, 323. As a result, the portion of the metal plate 100A facing the concave portion 311 is in contact with the surface of the concave portion 311 and is spaced from the convex portion 321. In the forming process of the metal plate 100A, the portion of the metal plate 100A facing the concave portion 311 is not compressed by the concave portion 311 and the convex portion 321.

Similarly to the description above, the thickness of the portion of the metal plate 100A facing the concave portion 322 becomes larger than the thickness of the portion compressed by the oblique portions 313, 323. As a result, the portion of the metal plate 100A facing the concave portion 322 abuts the surface of the concave portion 322 and is spaced from the convex portion 312. In the forming process of the metal plate 100A, the portion of the metal plate 100A facing the concave portion 322 is not compressed by the concave portion 322 and the convex portion 312.

As described above, after the preparation process, the metal plate 100A is shaped into a corrugated shape by sandwiching by the shaping rollers R11, R12. This process corresponds to the "shaping process" in this embodiment. In the shaping process, the metal plate 100A is partially compressed such that the thickness of the metal plate 100A at the apexes of the peak portion 110 and the valley portion 120 is larger than the thickness at the inclined portion 130. Specifically, the portion of the metal plate 100A to be the inclined portion 130 is compressed by the oblique portion 313 of the shaping roller R11 and the oblique portion 323 of the shaping roller R12, and thereby the thickness of the metal plate 100A at this portion becomes thin.

In the shaping process of the present embodiment, the portion of the metal plate 100A to be the peak portion 110 (the portion facing the concave portion 311) and the portion of the metal plate 100A to be the valley portion 120 (the portion facing the concave portion 322) are not compressed by the shaping rollers R11, R12. Instead of such configuration, the portion of the metal plate 100A to be the peak portion 110 or the valley portion 120 may be compressed by the shaping rollers R11, R12.

Specifically, in the condition shown in FIG. 7, the distance between the concave portion 311 and the convex portion 321 and the distance between the convex portion 312 and the concave portion 322 may be the same as the thickness D1 shown in FIG. 3. In this case, the portion of the metal plate 100A to be the peak portion 110 or the valley portion 120 is also compressed by the shaping roller R11. However, the amount of the compression is smaller than the amount of the compression at the portion of the metal plate 100A to be the inclined portion 130. Even in such configuration, the fins 100 having the shape shown in FIG. 3 can be manufactured.

Returning to FIG. 4, explanation will be continued. The correction rollers R21, R22 are for uniforming the height of the fin 100 throughout by sandwiching in the vertical direction the metal plate 100A having passed through the shaping rollers R11, R12, that is, the metal plate 100A that has the peak portions 110 and the valley portions 120.

Each of the correction rollers R21, R22 is a substantially cylindrical column shape, and is arranged such that the central axis thereof is along the direction perpendicular to the drawing sheet. The correction roller R21 disposed on the upper side rotates in the counterclockwise direction in FIG. 4 about its central axis. The correction roller R22 disposed on the lower side rotates in the clockwise direction in FIG. 4 about its central axis.

Figure 8:
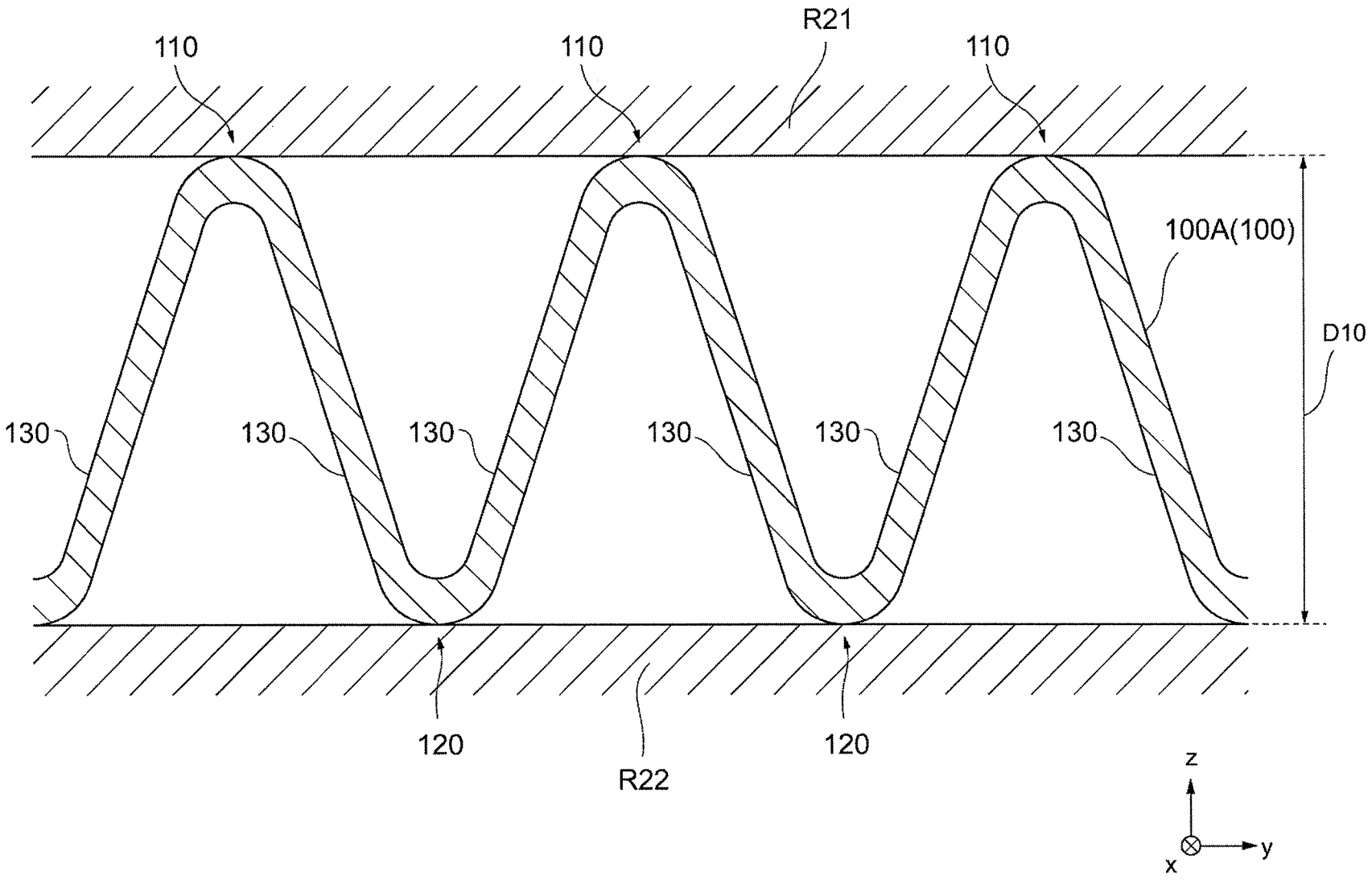
FIG. 8 is a diagram illustrating how the fin is corrected by rollers.

FIG. 8 shows a cross section of a portion where the correction roller R21 and the correction roller R22 are closest to each other. As shown in FIG. 8, the distance between the correction roller R21 and the correction roller R22 is equal to or smaller than the height D10 of the fin 100 shown in FIG. 3. By passing between the correction roller R21 and the correction roller R22, the height of the metal plate 100A in a state where the peak portions 110 and the valley portions 120 have formed is corrected so as to be uniform throughout. The correction roller R21 corresponds to a "third roller" of the present embodiment, and the correction roller R22 corresponds to a "fourth roller" of the present embodiment.

As described above, after the shaping process, the metal plate 100A in which the peak portions 110 and the valley portions 120 are formed is sandwiched by the correction rollers R21, R22, and thereby the height of the fin 100 becomes uniform throughout. This process corresponds to the "correction process" in the present embodiment.

As described above, in the shaping process of the present embodiment, the portions to be the peak portions 110 or the valley portions 120 are not compressed by the shaping rollers R11, R12. For this reason, the height of the fin 100 may vary depending on the place immediately after passing through the shaping rollers R11, R12. In the present embodiment, the height of the fin 100 can be made uniform throughout by the correction process.

As a comparative example of the present embodiment, a method of manufacturing a fin whose height is substantially uniform will be described with reference to FIG. 9. In the comparative example, the metal plate 100A is shaped into a corrugated shape by sandwiching the metal plate 100A, which has a flat shape at the beginning, by the rollers R101, R102, R111, R112, R121, R122, R131, R132, R141, R142, R151, R152, R161, R162 located on the upper side and the lower side. In the comparative example, multiple pairs of rollers for shaping the metal plate 100A into a corrugated shape are arranged along a direction in which the metal plate 100A is fed.

The metal plate 100A is shaped while passing through each roller, and the shape is gradually changed. In FIG. 9, the cross-sectional shape of the metal plate 100A immediately after passing each roller is shown above the respective roller. Each cross-sectional shape is shown such that the width direction of the metal plate 100A (the direction perpendicular to the drawing sheet) is along the up-down direction in FIG. 9.

Figure 9:
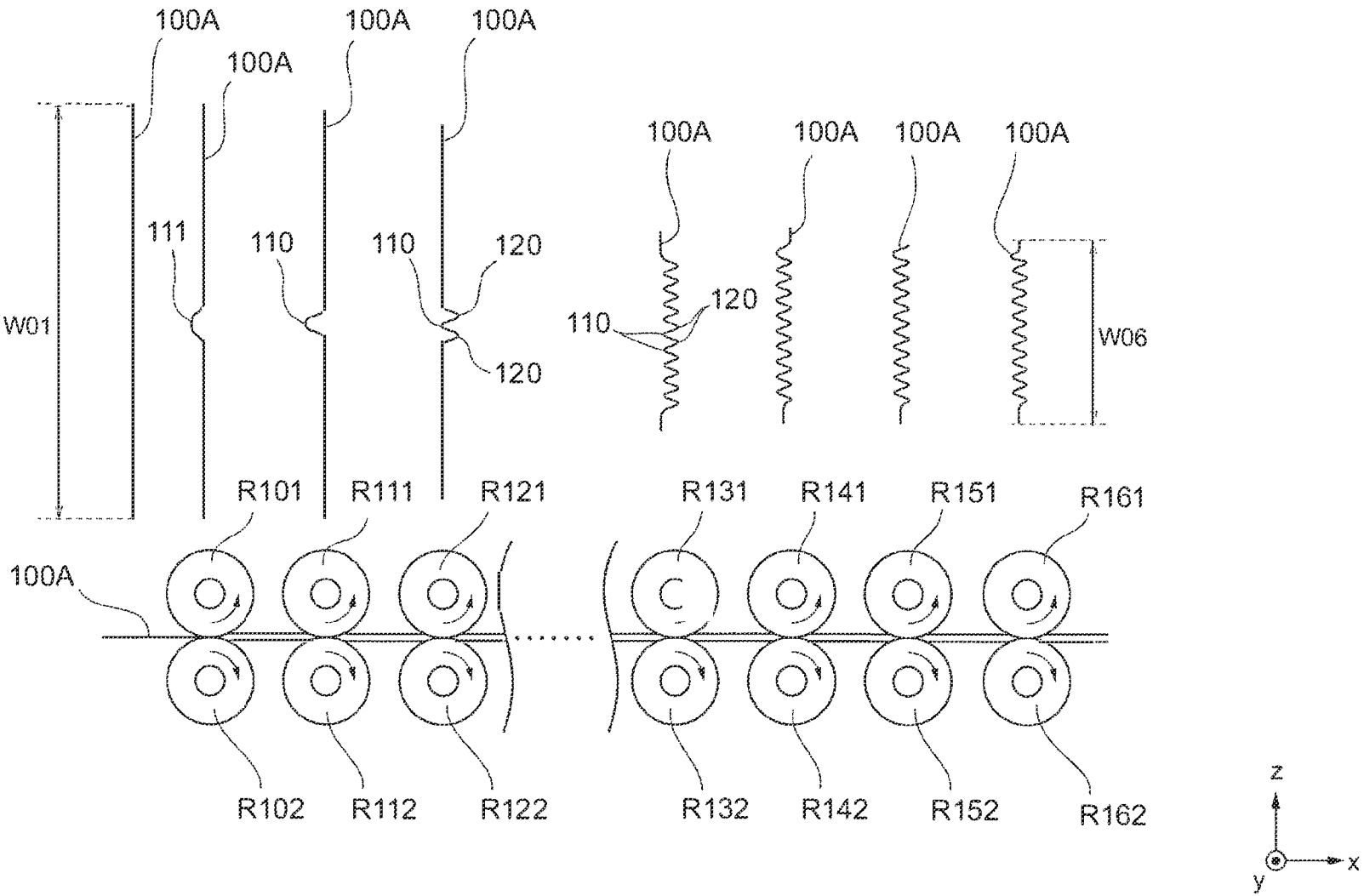
FIG. 9 is a diagram for explaining a method of manufacturing a fin according to a comparative example.

The leftmost rollers R101, R102 in FIG. 9 rotate in the same manner as the shaping rollers R11, R12 shown in FIG. 4 to send the metal panel 100A rightward. The same applies to the other rollers R111 and the like.

One concave portion (not shown) which is recessed inward is formed at the center position in the width direction of the roller R101 disposed on the upper side. One convex portion (not shown) which protrudes outward is formed in a part of the roller R102 disposed on the lower side facing the concave portion. When the metal plate 100A passes through the rollers R101, R102, one convex portion 111 is formed at the center position in the width direction of the metal plate 100A. At this time, since the metal plate 100A is pulled to the convex portion 111, the dimension in the width direction is slightly reduced.

The rollers R111, R112 are provided on the right side of the rollers R101, R102. The roller R111 located on the upper side has a concave portion (not shown) similarly to the roller R101, and the roller R112 located on the lower side has a convex portion (not shown) similarly to the roller R102. The shapes of the convex portion and the concave portion correspond to the shapes of the peak portions 110 to be finally formed in the fin. The convex portion 111 that has formed in the metal plate 100A is shaped as described above while passing through the rollers R111, R112 to be the peak portion 110.

Every time the metal plate 100A passes through the rollers, the peak portions 110 and the valley portions 120 are formed at a position that is the center in the width direction of the metal plate 100A. That is, the metal plate 100A is shaped such that the area in which the peak portions 110 and the valley portions 120 are formed expands outward from the center part in the width direction. The shaping of the metal plate 100A is completed and the metal plate 100A has the shape of the fin when the metal plate 100A passes through the rollers R161, R162 located in the rightmost part in FIG. 9. The thickness of the metal plate 100A (i.e. the thickness of the fin) at this time is almost the same as the thickness of the metal plate 100A at the beginning.

The dimension of the metal plate 100A in the width direction becomes smaller each time the convex portion to be the peak portion 110 and the concave portion to be the valley portion 120 are newly formed. In FIG. 9, the dimension of the metal plate 100A in the width direction at the beginning is shown as the width W01. Further, the dimension of the final metal plate 100A in the width direction is shown as a width W06 smaller than the width W01.

As described above, in the method of manufacturing a fin in the comparative example, the formation of the peak portions 110 and the valley portions 120 using rollers is performed multiple times. This is because, if all the peak portions 110 and the like are formed at one time by only one pair of rollers, the amount of drawing in of the metal plate 100A along the width direction may be too large, and breakage or the like may occur in part of the metal plate 100A.

In contrast, in the manufacturing method according to the present embodiment described with reference to FIGS. 4 to 8, all the peak portions 110 and the valley portions 120 are formed at one time by only one set of shaping rollers R11, R12. However, in the present embodiment, since the metal plate 100A is compressed and spread by the oblique portion 313 and the oblique portion 323, the drawing-in of the metal plate that may occur in the manufacturing method according to the comparative example hardly occurs. Since the dimension in the width direction of the metal plate 100A hardly changes before and after the shaping process, it may be unnecessary to provide multiple sets of rollers in consideration of breakage or the like of the metal plate 100A.

According to the present embodiment, since the number of the rollers for the shaping process can be smaller than that in the comparative example, the cost for replacing the rollers which are consumable parts can be reduced. In addition, there may be also an advantage that the entire process can be easily managed.

In the above, although the shape and manufacturing method of the fin 100 used as an inner fin of the heat exchanger 10 were explained, the shape and manufacturing method of this fin 100 may be applied to the fin 13 which is an outer fin.

The present embodiments have been described above with reference to concrete examples. However, the present disclosure is not limited to those specific examples. Those specific examples that are appropriately modified in design by those skilled in the art are also encompassed in the scope of the present disclosure, as far as the modified specific examples have the features of the present disclosure. Each element included in each of the specific examples described above and the arrangement, condition, shape, and the like thereof are not limited to those illustrated, and can be changed as appropriate. The combinations of elements included in each of the above described specific examples can be appropriately modified as long as no technical inconsistency occurs.

What is claimed is:

1. A method of manufacturing a corrugated fin in which peak portions and valley portions extending along a first direction are arranged alternately in a second direction perpendicular to the first direction, the method comprising:

preparing a metal plate that has a flat shape;

shaping the metal plate into a corrugated shape by sandwiching the metal plate by a first roller and a second roller, wherein the shaping includes compressing at least a part of the metal plate that is to be inclined portions by the first roller and the second roller such that a thickness of the metal plate at each apex of the peak portions and the valley portions is larger than a thickness of the inclined portions of the metal plate that connects the peak portions and the valley portions adjacent to each other, thereby the part of the metal plate becomes thin; and correcting a height of the corrugated fin between the peak portions and the valley portions to uniform the height of the corrugated fin by sandwiching the corrugated fin, in which the peak portions and the valley portions have been formed, between a third roller and a fourth roller after the shaping, such that a thickness at each apex of the peak portions and the valley portions is larger than a thickness of the inclined portions that connect the peak portions and the valley portions adjacent to each other.

2. The method according to claim 1, wherein in the shaping, portions of the metal plate that are to be the peak portions or valley portions are not compressed by the first roller and the second roller.

3. The method according to claim 1, wherein in the shaping, the first roller and the second roller are in contact with only the inclined portions, and in the correcting, the third roller and the fourth roller are in contact with only the peak portions and the valley portions.

4. The method according to claim 3, wherein in the shaping, a portion of the metal plate to be the peak portion and a portion of the metal plate to be the valley portion are not compressed by the first roller and the second roller.

5. The method according to claim 4, wherein in the shaping, the metal plate is compressed by oblique portions of the first roller and the second roller, and a material of the metal plate is pushed to portions that are not compressed.

6. The method according to claim 5, wherein in the correcting, the third roller and the fourth roller uniform the height of the corrugated fin throughout.

7. The method according to claim 1, wherein in the correcting, a relationship between the thickness at each apex of the peak portions, the thickness at each apex of the valley portions and the thickness of the inclined portions the same as in the shaping process.

* * * * *